US006505900B2

(12) United States Patent
Frederick

(10) Patent No.: US 6,505,900 B2
(45) Date of Patent: Jan. 14, 2003

(54) MOVING RACKS THAT SUPPORT HEAVY MATERIALS

(75) Inventor: Dennis Frederick, Parker, CO (US)

(73) Assignee: Steel Storage Systems, Inc., Commerce City, CO (US)

( * ) Notice: Subject to any disclaimer, the term of this patent is extended or adjusted under 35 U.S.C. 154(b) by 59 days.

(21) Appl. No.: 09/770,749

(22) Filed: Jan. 24, 2001

(65) Prior Publication Data

US 2002/0096982 A1 Jul. 25, 2002

(51) Int. Cl.[7] ..... A47B 88/00

(52) U.S. Cl. ..... 312/319.7; 312/330.1; 108/137; 74/89.13

(58) Field of Search ..... 312/319.7, 330.1, 312/331, 201, 311, 294; 211/126.15, 126.2, 144, 153, 105; 74/89.13; 108/102, 137, 143, 147.11, 147.7

(56) References Cited

U.S. PATENT DOCUMENTS

| | | | | | |
|---|---|---|---|---|---|
| 1,914,767 | A | * | 6/1933 | Beckwith | 108/143 |
| 3,517,624 | A | * | 6/1970 | Helms | 108/102 X |
| 3,923,354 | A | | 12/1975 | Young | |
| 4,123,126 | A | | 10/1978 | Querengasser | |
| 4,417,524 | A | | 11/1983 | Quinn et al. | |
| 4,467,924 | A | | 8/1984 | Morcheles | |
| 4,527,938 | A | * | 7/1985 | Leavitt, Jr. | 414/280 |
| 4,627,364 | A | * | 12/1986 | Klein et al. | 108/147 |
| 4,756,657 | A | * | 7/1988 | Kinney | 414/281 |
| 5,024,164 | A | | 6/1991 | Leist | |
| 5,058,507 | A | | 10/1991 | Muth | |
| 5,160,189 | A | | 11/1992 | Johnston et al. | |
| 5,199,778 | A | * | 4/1993 | Aoki et al. | 108/147 X |
| 5,913,584 | A | * | 6/1999 | Swindell et al. | 312/306 X |
| 5,927,926 | A | * | 7/1999 | Yagi et al. | 414/280 |
| 6,027,190 | A | | 2/2000 | Stewart et al. | |
| 6,065,821 | A | * | 5/2000 | Anderson et al. | 108/108 X |
| 6,112,917 | A | | 9/2000 | Baker et al. | |

FOREIGN PATENT DOCUMENTS

| | | | | |
|---|---|---|---|---|
| JP | 52053700 | * | 4/1977 | 108/143 |
| JP | 05180295 | * | 7/1993 | 74/89.13 |

* cited by examiner

*Primary Examiner*—Jose V. Chen
*Assistant Examiner*—Hanh V. Tran
(74) *Attorney, Agent, or Firm*—Sheridan Ross P.C.

(57) ABSTRACT

A storage rack with vertically arranged, horizontal drawers movable by a crank mechanism is provided. Each individual drawer of the storage rack has a gear mechanism which is connected to a drive shaft with wheels. A crank handle is provided to engage the gear mechanism of any individual drawer and provide motive force to the drive shaft. The rotation of the crank causes the drive shaft to rotate and, in turn, rotates the wheels. The wheels travel along respective track members attached the storage rack to move a drawer in and out relative to the storage rack.

22 Claims, 12 Drawing Sheets

MOVING RACKS THAT SUPPORT HEAVY MATERIALS

FIELD OF THE INVENTION

The present invention relates to moving racks that support relatively heavy materials and, in particular, to crank mechanisms for moving such racks.

BACKGROUND OF THE INVENTION

Relatively long, heavy, substantially flat objects, such as angle iron or other elongate structural shapes and sheet steel, are common in industrial applications. For example, these objects or materials are often used in manufacturing operations as component parts in a final product or facility. Since product manufacturing is typically a continual operation, it is often necessary to carry an inventory of these materials. In order to make efficient use of available floor space, such long, relatively flat objects are best stored horizontally in vertically stacked racks.

Current vertical storage racks for elongated materials are generally of three types: "pigeon hole"-type racks; racks with manual rollout drawers; and racks with automated rollout drawers. The "pigeon hole" rack typically requires one or more persons to push or pull individual pieces in or out of a storage rack. The obvious drawback of the "pigeon hole" rack is the size limitation of material that can be stored in the rack. Large heavy materials cannot be easily manipulated by one or two persons.

The rack with manual rollout drawers improves upon the "pigeon hole" rack in that the moveable drawers allow access to the relatively long, materials by a fork lift or a sling on a hoist. However, this rack may also be ergonomically hazardous to an individual opening or closing a drawer. The inherent weight of the materials coupled with friction of the slidable surface may require large amounts of force to open and close the drawers. The individual indexing the drawers may, for example, strain his or her back when pulling the drawer open or pushing it closed. This is especially true for racks at a level other than between the individual's waist and shoulders. Additionally, lower racks may require the individual to crouch to reach the drawer, thus compounding the ergonomic hazards. Similarly, drawers above shoulder level may require the individual to stand on a ladder or stool. The use of a ladder or a stool increases the risk of injury due to falling.

Racks with automated rollout drawers have been developed to reduce the risk of injury to individuals opening and closing the racks. Unfortunately, many of the automated racks require the use of complex mechanical and electrical equipment, including motors, chains and sprockets, and rack and pinion systems. The complexity of these automated systems increases the necessary maintenance costs associated with the racks. In the event of required maintenance, such as a broken chain, production may be interrupted causing costly delays because access to materials required for production is impossible.

Based on the foregoing, there is a need for racks that support relatively long, heavy materials to have rollout drawers which do not require an individual to place himself or herself in an ergonomically compromising position. It would also be advantageous for such racks to have a simple design such that construction and maintenance costs allow for an affordable product and that the risk of downtime is reduced.

SUMMARY OF THE INVENTION

The present invention provides a rack with rollout drawers and a crank mechanism for moving the drawers that is particularly well suited to an individual worker opening and closing the drawers. The crank mechanism is relatively simple such that construction and maintenance of the rack are minimal.

The rack with rollout drawers of the present invention includes a rack assembly including a plurality of drawers arranged vertically, side frames and a drawer drive assembly. Each drawer may be independently moved in and out relative to the side frames by riding on wheels along a portion of the side frames. Two wheels of each individual drawer are connected to each other by a main shaft such that one of the wheels travels along a portion of one side frame, and the other wheel travels along a portion of the other side frame.

The individual drawers may also have a coupling device or crank shaft mechanism that is connected to the main shaft of the drawer. The coupling device can impart movement to the main shaft. The coupling device may include at least one coupling shaft and a shaft moving unit. In one embodiment, the shaft moving unit may include a crank handle connected to the coupling shaft. The coupling shaft may be in substantially the same plane as the main shaft and perpendicular to the main shaft.

The drawer drive assembly may also include a gear mechanism connected to the main shaft. The gear mechanism may have a first gear attached to the main shaft. The drawer drive assembly may also have a second gear attached to the coupling shaft and engaging with the first gear attached to the main shaft. The gear mechanism provides a substantial mechanical advantage for a person attempting to open or close a drawer. Thus, the physical exertion required of the person is decreased and, with it, the possibility of physical injury.

The wheels of the individual drawers may be attached to the main shaft at a side wall of the drawer. The drawer may also include a flange bearing adjacent to each wheel attached to the main wheel. Additionally, the flange bearing may be spaced from the wheel.

The side frames of the rack can include track members, with an inner surface and an outer surface, for the drawer wheels to travel along. The wheels may then travel along the track member by riding between the inner surface and outer surface of the track member. The flange bearing, if provided, may be located at least partially inward of the inner surface.

The support rack of the present invention may also include a housing member to surround at least a portion of the gear mechanism. The housing member may provide additional support to the main shaft and may also protect the gear mechanism from damage for objects being placed or stored upon the drawer.

Based on the foregoing summary, a number of worthwhile aspects of the present invention can be readily identified. The storage rack allows a single person to open and close the rack with reduced effort and risk of injury. The gear mechanism provides a mechanical advantage to the individual operating the rack to enhance operation. Additionally, the drawer drive assembly is a simple combination of gears, drive shafts and wheels. Thus, the simple design provides an affordable rack with minimal on-going maintenance costs. The design of the present invention also lends itself to automation by the mere connection of a motor to the coupling shaft. This minor increase in complexity can further facilitate drawer movement.

Additional advantages of the present invention will become readily apparent from the following discussion, particularly when taken together with the accompanying drawings.

DETAILED DESCRIPTION

Figure 1:
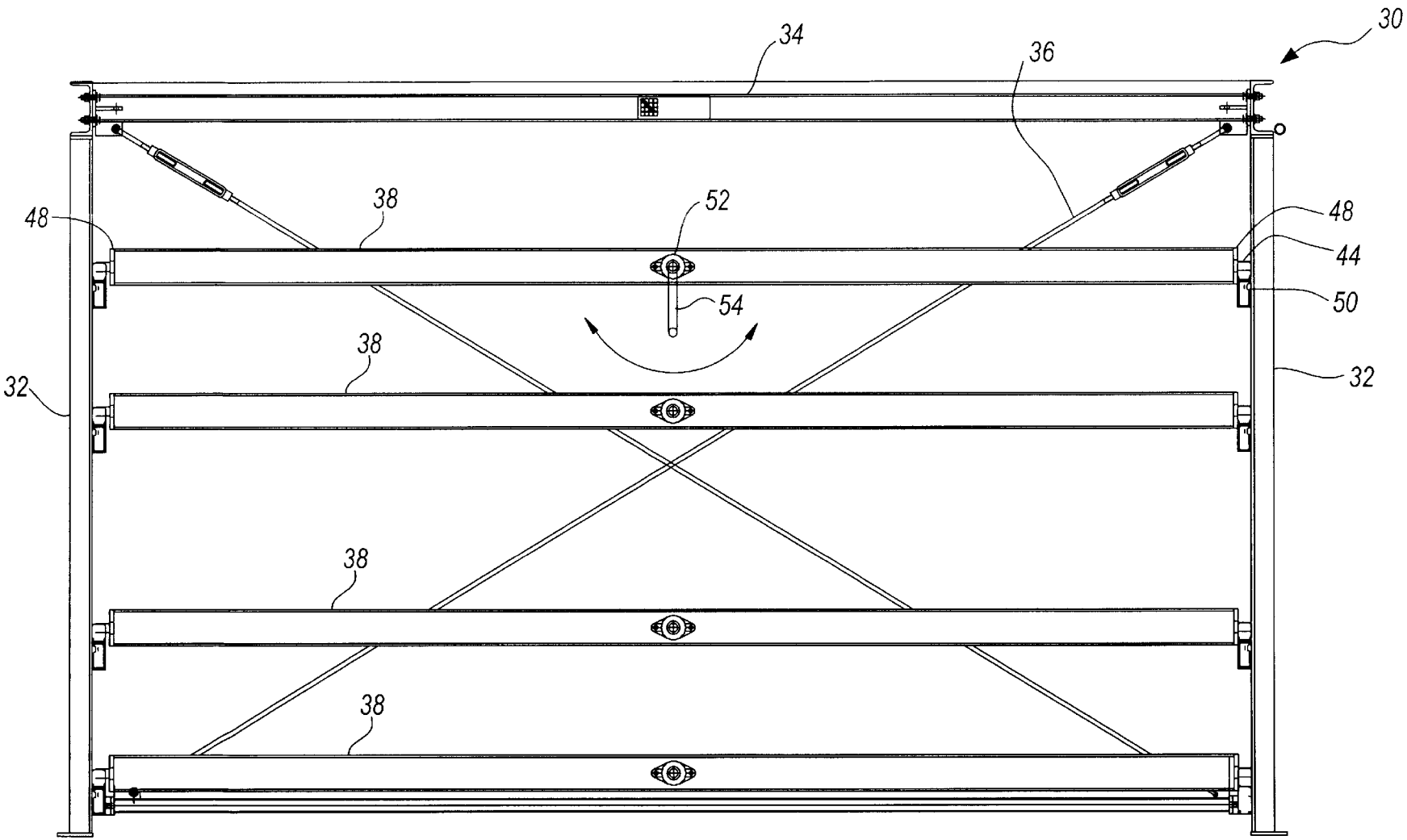
FIG. 1 is a front elevation view of one embodiment of the storage rack with crank mechanism of the present invention.

While this invention is susceptible to embodiments in many different forms, there is shown in the drawings and will herein be described in detail, preferred embodiments of the invention with the understanding that the present disclosure is to be considered as being exemplary of the principles of the invention and is not intended to limit the broad aspects of the invention to the embodiments illustrated.

Referring to FIG. 1, a front elevation view of one embodiment of the storage rack of the present invention is shown. The storage rack 30 is comprised of two side frames 32 and may include a top member 34 and cross members 36. The side frames 32, the top member 34, and the cross members 36 form the base structure of the storage rack 30. The storage rack 30 can be a standard welded frame construction having tube frames or a bolt construction utilizing a more channel-like design. Individual drawers 38 are arranged vertically within the storage rack 30. The drawer 38 has an outer member 40 and may have a plurality of support members 42. The drawer 38 includes drive wheels 44 which are connected to a main shaft 46 at opposing lateral sides 48 of the drawer 38. The drive wheels 44 travel along respective track members 50 which are connected to the side frames 32. A coupling device 52 is mounted through the drawer outer member 40 to move the main shaft 46. A crank handle 54 is connected to the coupling device 52 to move the coupling device 52 and thus the main shaft 46.

Figure 2:
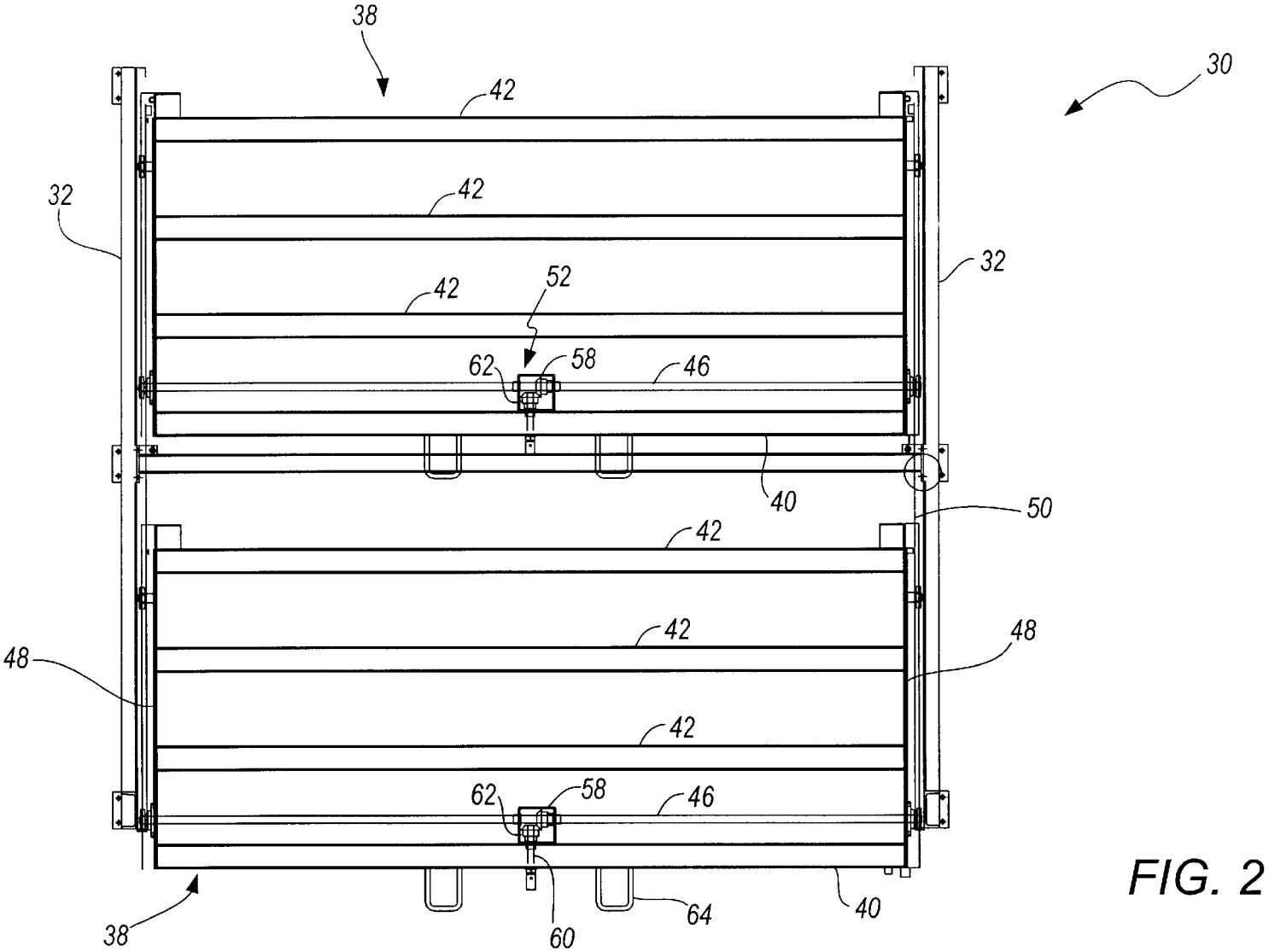
FIG. 2 is a top view of the storage rack with crank mechanism of FIG. 1, with one drawer shown in the extended position.
Figure 3:
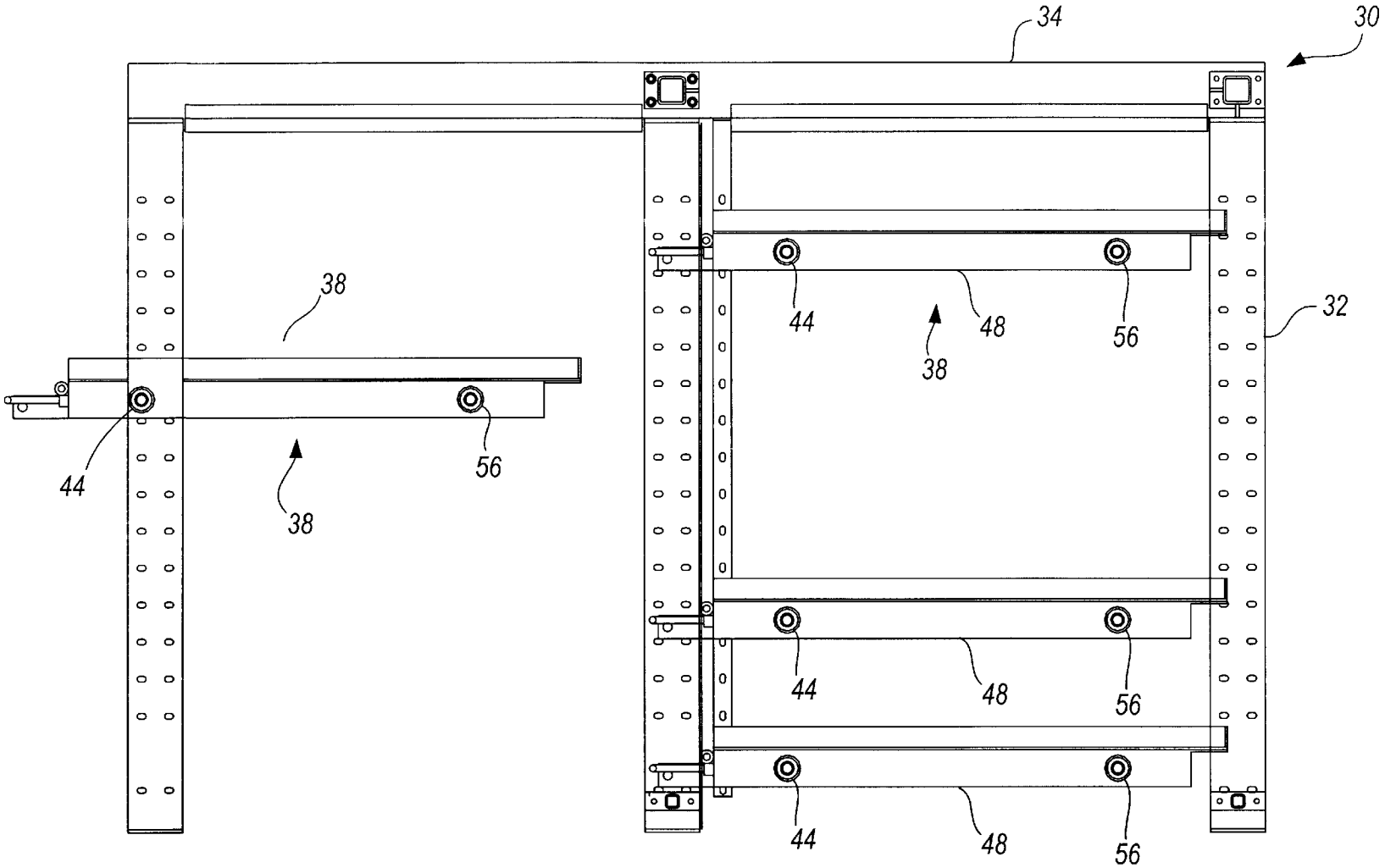
FIG. 3 is a side elevation view of the storage rack with crank mechanism of FIG. 1, with track members removed for clarity.

Referring now to FIGS. 2 and 3, the storage rack 30 is shown with one drawer 38 in the open position. The support members 42 and the outer member 40 are more clearly shown to form a drawer 38 with the lateral sides 48. The extended drawer 38 is shown with drive wheels 44 and follower wheels 56 in the track member 50 (FIG. 2). Again, the drive wheels 44 are connected to opposing ends of the main shaft 46. The follower wheels 56 are attached to respective lateral sides 48 at the drawer 38 and provide rolling support for the drawer 38 without providing a motive force. A first gear 58 is connected to the main shaft 46 along a middle portion of the shaft 46. Additionally, the coupling device 52 is shown more clearly. The coupling device 52 includes a coupling shaft 60. The coupling shaft 60 extends through the outer member 40 of the drawer 38. Connected to one end of the coupling shaft 60 is a second gear 62 which meshes with the first gear 58. The crank handle 54 may be attached to the opposite end of the coupling shaft 60 to initiate movement of the coupling shaft 60, and thus the main shaft 46 to move the drawer 38. The optional feature of hand holds 64 is shown in this drawing. The hand holds 64 may be used to open and close a drawer 38 by manual force.

With continued reference to FIG. 3, the drawers 38 on the right are shown in the closed position. The drawer 38 on the left is shown in the open position. From this view it is clear that the drawers 38, when closed, form a vertical storage area. The drawer 38, as shown, is constructed of an outer member 40 and three support members 42. It should be noted, however, that more or fewer support members 42 may be used to construct the drawer 38 depending upon the strength requirements of the drawer 38 and spacing required based on the size of the supported objects.

Figure 4:
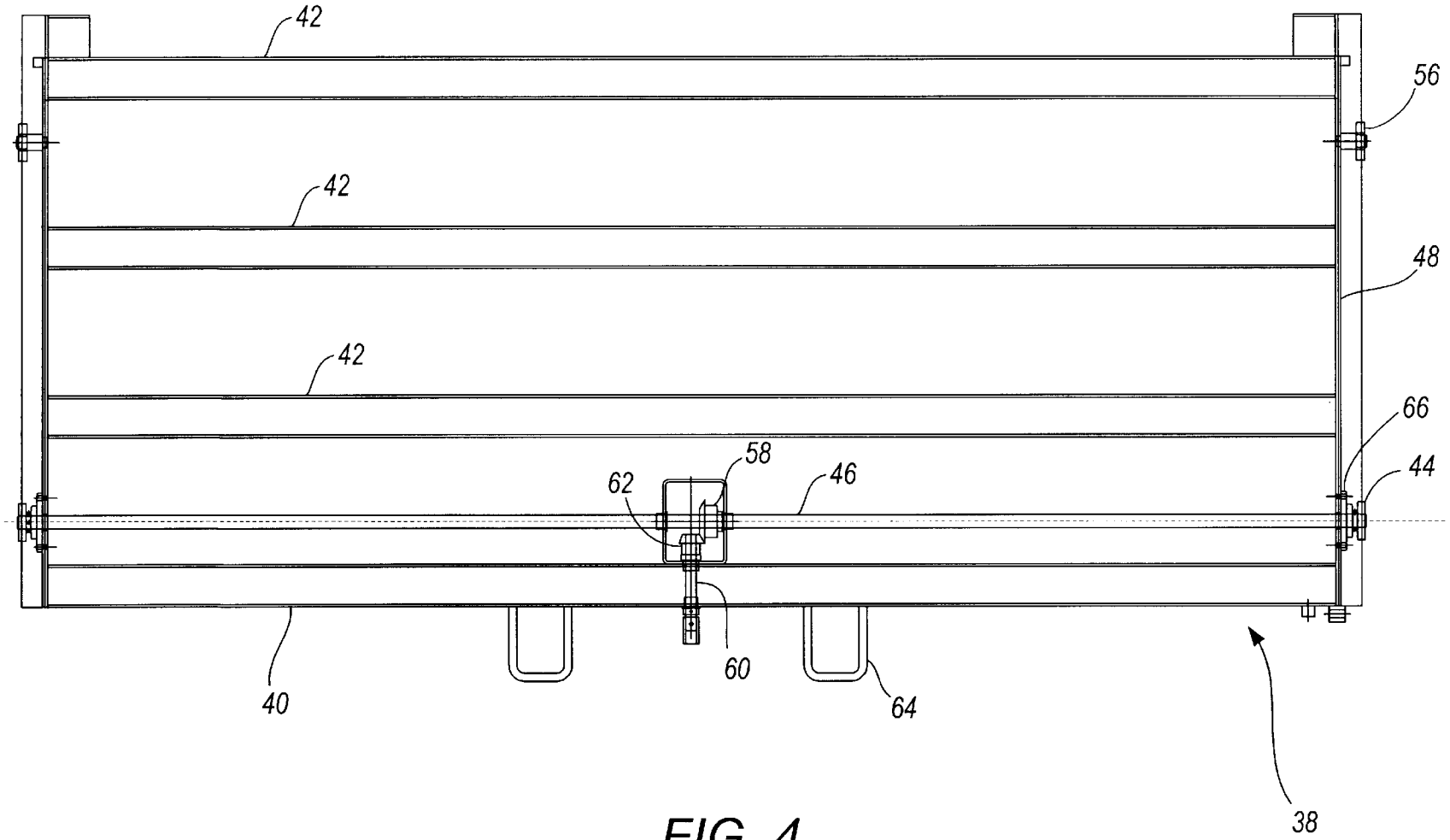
FIG. 4 is a top view of one embodiment of a drawer for use with the storage rack with crank mechanism of the present invention.

Referring now to FIG. 4, a single drawer 38 is shown in top view. In this view, an alternative embodiment of the connection of the main shaft 46 to the drawer lateral side 48 is shown. The drive wheels 44 are again attached to the main shaft 46. However, in this embodiment, the main shaft is supported by flange bearings 66 secured to the lateral sides 48. The flange bearings 66, in this embodiment, are mounted on the exterior of the lateral sides 48 and adjacent to, but separated from, the drive wheels 44. The axles of the follower wheels 56 are mounted directly to the drawer lateral sides 48. As in the embodiment of FIGS. 1–3 above, the coupling device 52 includes a coupling shaft 60 passing through the drawer outer member 40 and connected to a second gear 62. The second gear 62 engages a first gear 58 on the main shaft 46. Optional hand holds 64 are also included in this embodiment.

Figure 5:
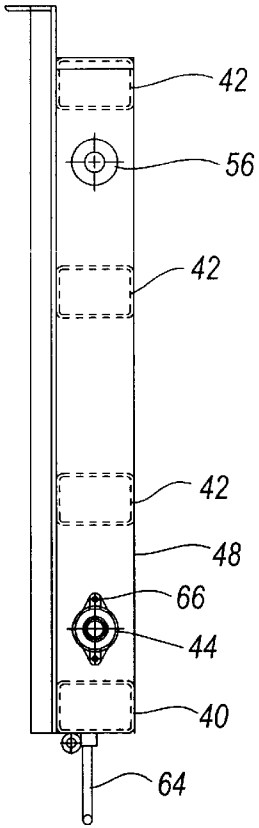
FIG. 5 is a side elevation view of the drawer of FIG. 4.
Figure 6:
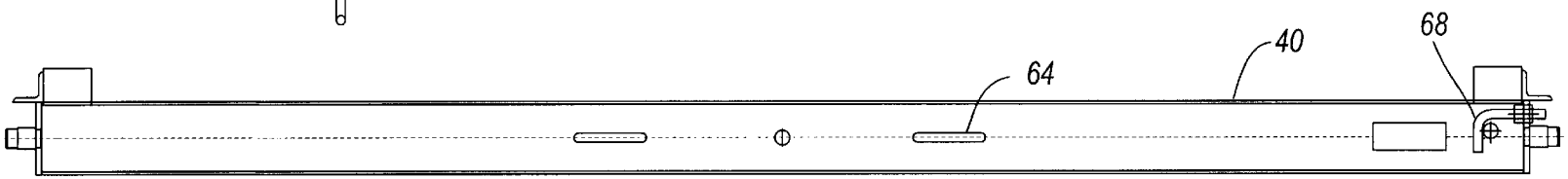
FIG. 6 is a front elevation view of the drawer of FIG. 4 with crank and coupling device not shown.

FIG. 5 shows drawer 38 of FIG. 4 in side elevation view. In this view, the flange bearing 66 is shown attached to the lateral side 48 for support of the main shaft 46. Similarly, the follower wheel 56 is shown attached directly to the lateral side 48. FIG. 6 shows the same drawer in front elevation view. In this view, the optional feature of a locking pin 68 is shown. In this embodiment, the locking pin 68 is mounted on the outer member 40 of the drawer 38 near one lateral side 48. The pin 68 may be moved toward the exterior of the rack 30 to engage a corresponding receiver in the side frame 32 to prevent unwanted movement of the drawer 38 relative to the side frame 32.

Figure 7:
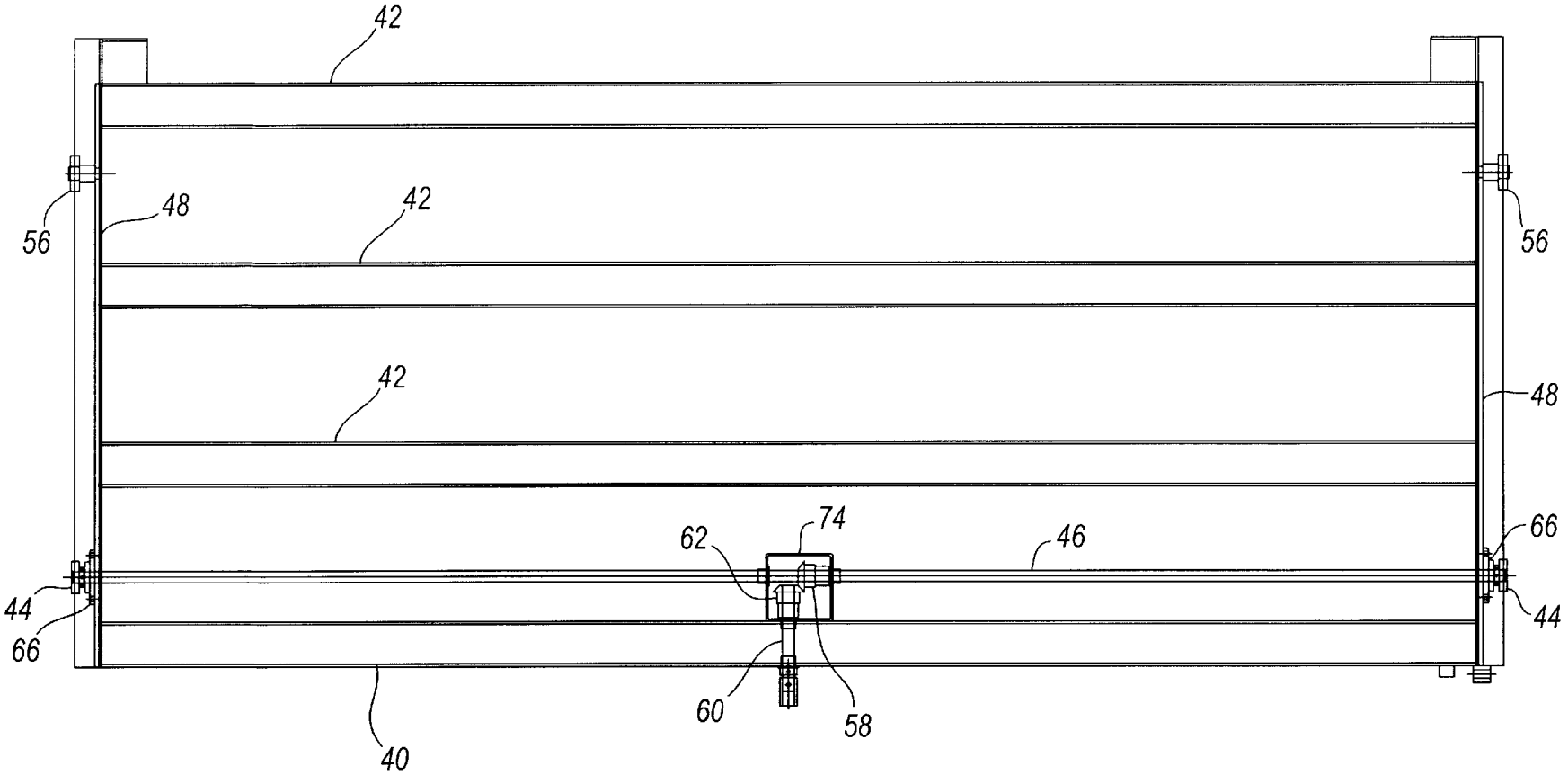
FIG. 7 is a top view of an alternative embodiment of the drawer for use with the storage rack with crank mechanism of the present invention.

Referring now to FIG. 7, a drawer 38 is shown in top view. In this embodiment, the drawer 38 does not include the hand holds 64.

Figure 8:
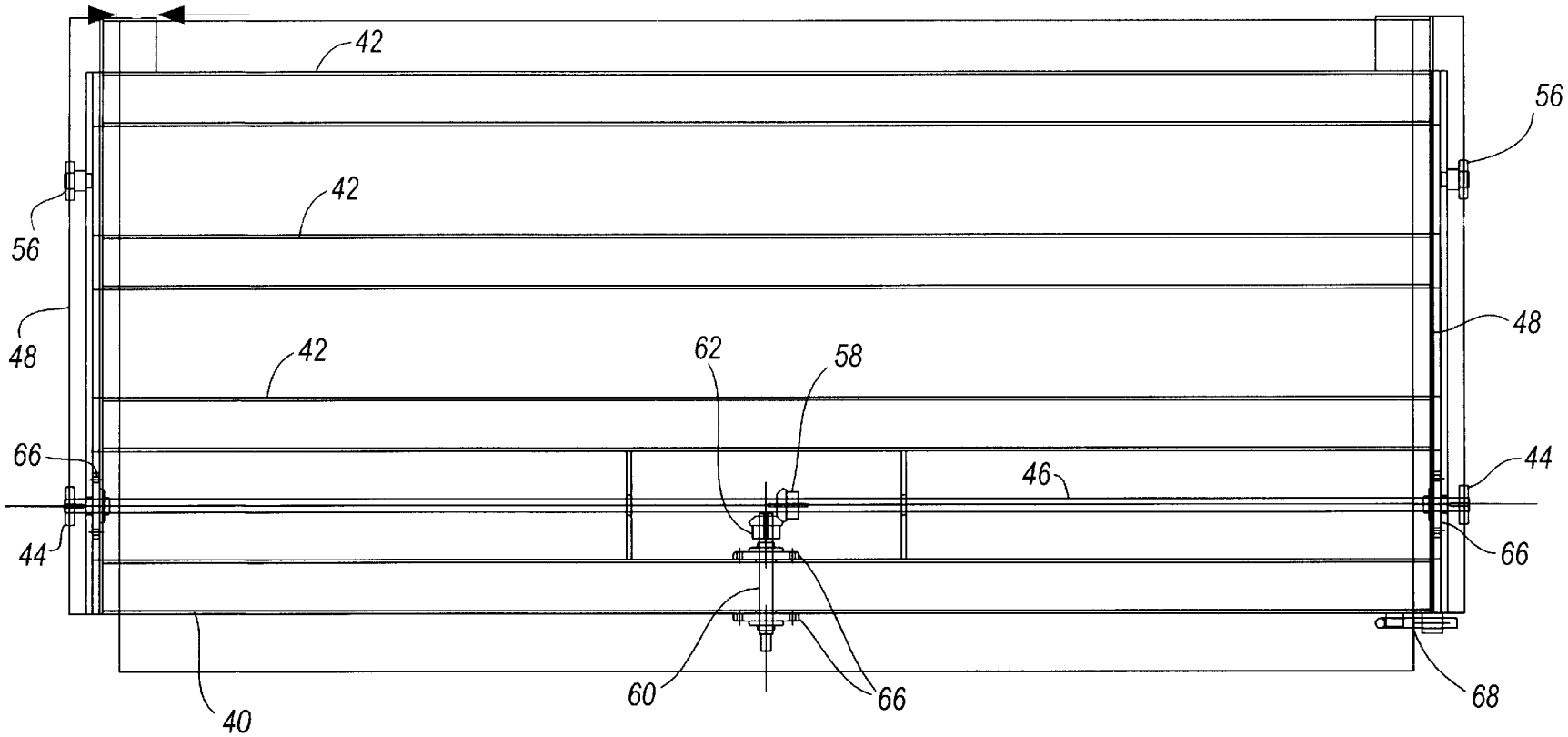
FIG. 8 is a top view of another alternative embodiment of the drawer for use with the storage rack with crank mechanism of the present invention.

With reference to FIG. 8, another embodiment of a drawer 38 is shown in top view. In this embodiment, the coupling shaft 60 is shown supported by flange bearings 66 on opposite sides of the drawer outer member 40. Also in this view, the locking pin 68 is shown in the unlocked position. The end of the locking pin 68 does not extend beyond the lateral edge of the track member 50, and thus cannot engage a corresponding receiver in the side frame 32.

Figure 9:
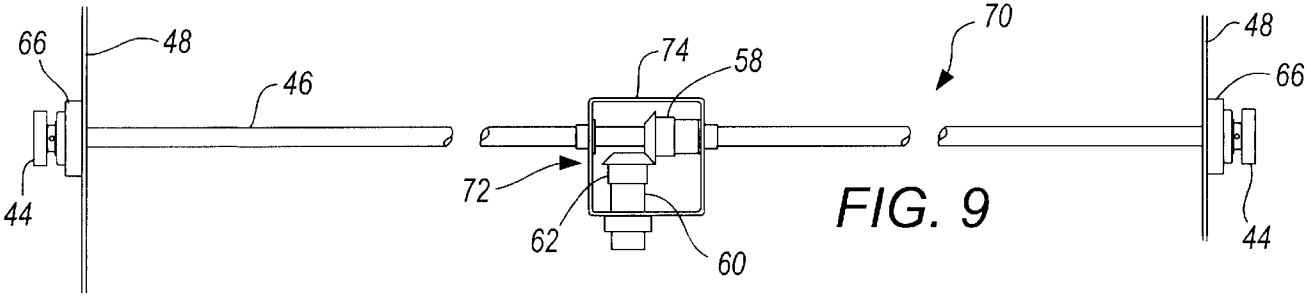
FIG. 9 is a plan view of one embodiment of the drawer drive assembly of the present invention.

Referring now to FIG. 9, one embodiment of the drawer drive assembly is shown. The drawer drive assembly 70 includes the main shaft 46 with the attached first gear 58, the coupling shaft 60 with attached second gear 62 the drive wheels 44, and in this embodiment flange bearings 66. The first gear 58 and the second gear 62 engage to form gear mechanism 72. Also in this embodiment, a housing member 74 is provided to surround at least a portion of the drawer drive assembly 70.

Figure 10:
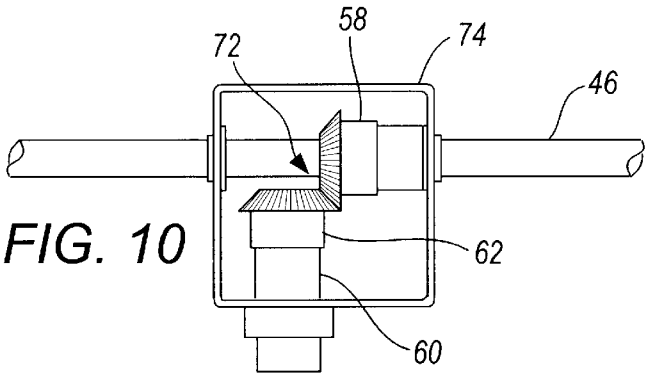
FIG. 10 is an enlarged plan view of one embodiment of the gear mechanism of the drawer drive assembly of FIG. 9.

FIG. 10 shows gear mechanism 72, including housing member 74, of the drawer drive assembly 70 in an enlarged view. In this view it can be seen that the coupling shaft 60 does not extend beyond the end of second gear 62. This prevents the coupling shaft 60 from interfering with the main shaft 46 which, in contrast, extends through the first gear 58, passing through the housing member 74, to couple the drive wheels 44.

Figure 11:
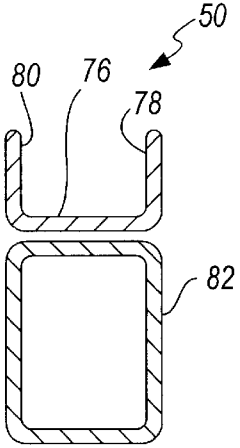
FIG. 11 is a cross-sectional view of one embodiment of the track member of the present invention.

Referring now to FIG. 11, one embodiment of the track member is shown in cross section. The track member 50, in this embodiment, has a bearing surface 76, an outer surface 78, and an inner surface 80. The outer surface 78 and the inner surface 76 are on opposite sides of the bearing surface to form a U-shaped channel. The track member 50 may be mounted on a track member support 82 to provide additional structural integrity to the track member 50. The width dimension between the inner surfaces of the outer surface 78 and the inner surface 80 are selected to allow the drive wheels 44 and follower wheels 56 to travel within the channel.

Figure 12:
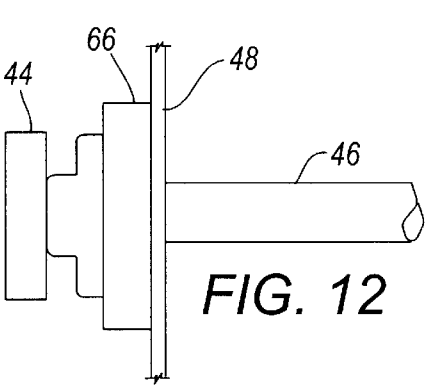
FIG. 12 is a front elevation view of one embodiment of a wheel and flange bearing assembly of the drawer drive assembly of the present invention.

Referring now to FIG. 12, an enlarged plan view of the drive wheel 44 is shown. In this embodiment, the drive wheel 44 is connected to the main shaft 46. The main shaft 46 extends through the lateral side 48 of the drawer 38. The main shaft 46 is supported by flange bearing 66 attached to the outer surface of the lateral side 48. The flange bearing 66 is spaced, to some extent, from the drive wheel 44 to prevent unnecessary friction between the components.

Figure 13:
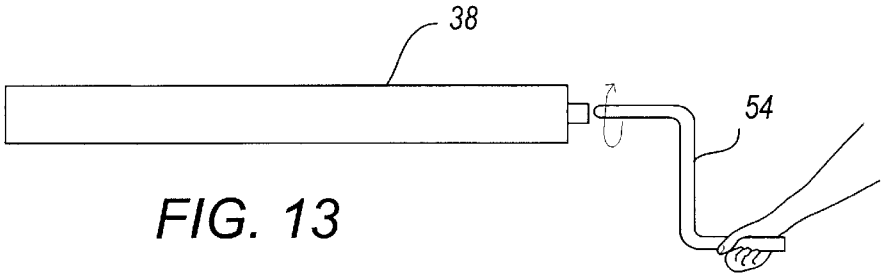
FIG. 13 is a side elevation view of one embodiment of the drawer for use with the storage rack with crank mechanism of the present invention showing attachment of a hand crank.

Referring now to FIG. 13, a drawer 38 is shown in side elevation with a crank handle 54. The crank handle 54 may be connected with the external end of the coupling shaft 60. The crank handle 54 is rotated in one direction, e.g. counter-clockwise, to open the drawer 38 and in the opposite direction to close the drawer 38. The rotation of the crank handle 54 rotates the coupling shaft 60, and thus the second gear 62, which in turn causes the first gear 58, and thus the main shaft 46, to rotate. The rotation of the main shaft 46 provides a motive force to the drive wheels 44 which are attached to the ends of the main shaft 46, which then roll along the track member 50.

Figure 14:
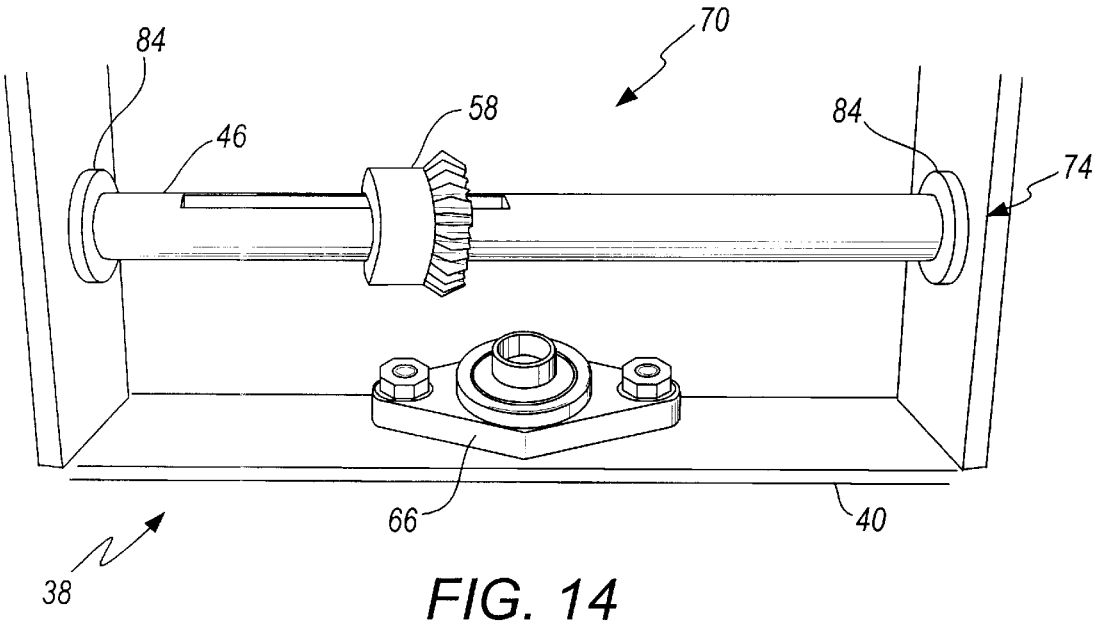
FIG. 14 is a perspective view of one embodiment of the gear mechanism of the present invention with one gear removed.

Referring now to FIG. 14, one embodiment of the drawer drive assembly 70 is shown in perspective view. For illustration purposes, the coupling shaft 60 and the second gear 62 are omitted from the drawing. In this embodiment, a flange bearing 66 is provided on the interior surface of the outer member 40 of the drawer 38. The flange bearing 66 supports the coupling shaft 60 when it is inserted through the outer member 40. The main shaft 46 is shown with a first gear 58 attached and extending through the housing member 74. As seen in FIG. 14, the main shaft 46 may be supported by providing bearings 84 adjacent to the main shaft 46 and attached to the housing member 74. With the housing member 74 secured to the drawer 38, for example along the outer member 40, the bearings 84 and housing member 74 may provide additional stability to the main shaft 46.

Figure 15:
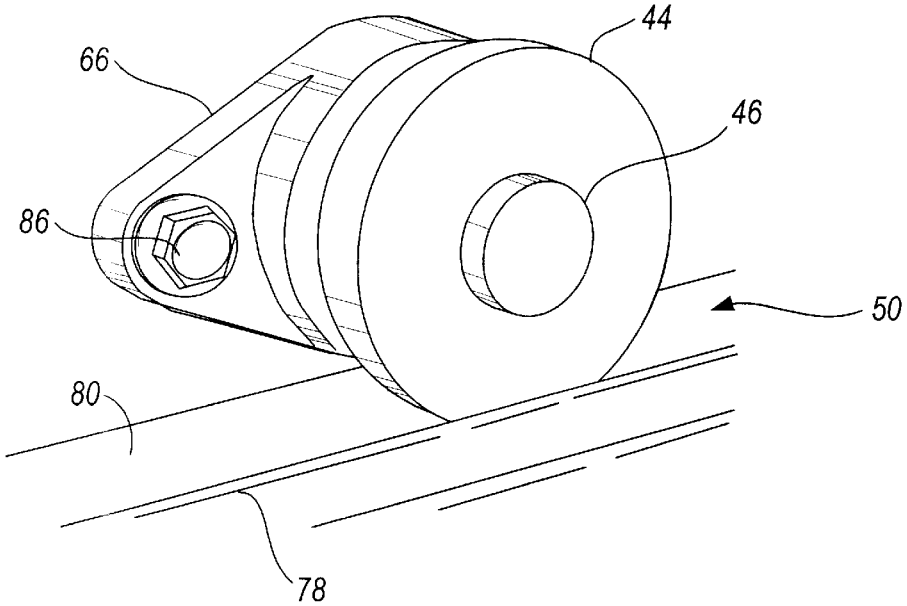
FIG. 15 is a perspective view of one embodiment of a wheel and flange bearing assembly shown in relation to an embodiment of the track member of the present invention.

Referring next to FIG. 15, a perspective view of a drive wheel 44 is shown. The drive wheel 44 is attached to the main shaft 46. The main shaft 46 extends through the lateral side 48 of the drawer 38 and is supported by flange bearing 66. In this embodiment, the flange bearing 66 is attached to the lateral side 48 by bolt 86. The drive wheel 44 travels along track member 50 and is positioned between the outer surface 78 and the inner surface 80 of the track member 50.

Figure 16:
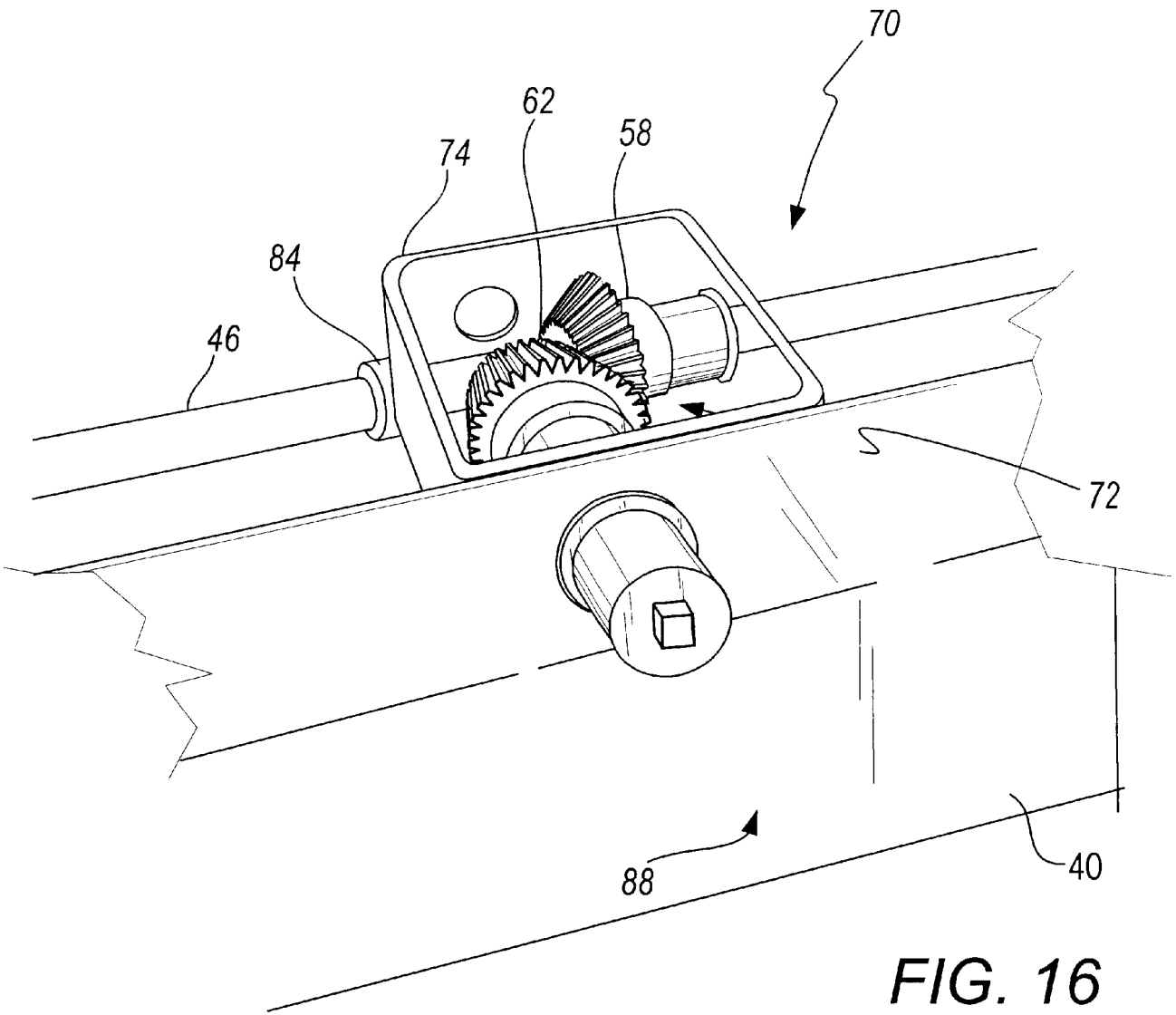
FIG. 16 is a perspective view of an embodiment of the drawer drive assembly of the present invention.

Referring now to FIG. 16, a portion of a drawer drive assembly is shown in perspective view. The drawer drive assembly 70 of this embodiment includes a main shaft 46 with attached first gear 58 and a coupling shaft 60 with attached second gear 62 to form a gear mechanism 72. The gear mechanism is contained within housing member 74. The housing member 74 is attached to the outer member 40 of a drawer 38 and supports the main shaft 46 via attached bearings 84. Also shown in FIG. 16 is a crank handle key 88 for selective engagement of the crank handle 54. The crank handle 54 may have a mating geometry to the crank handle key 88 such that the crank handle may be placed on the crank handle key 88 and rotated to open and close the drawer 38 as described above.

Figure 17:
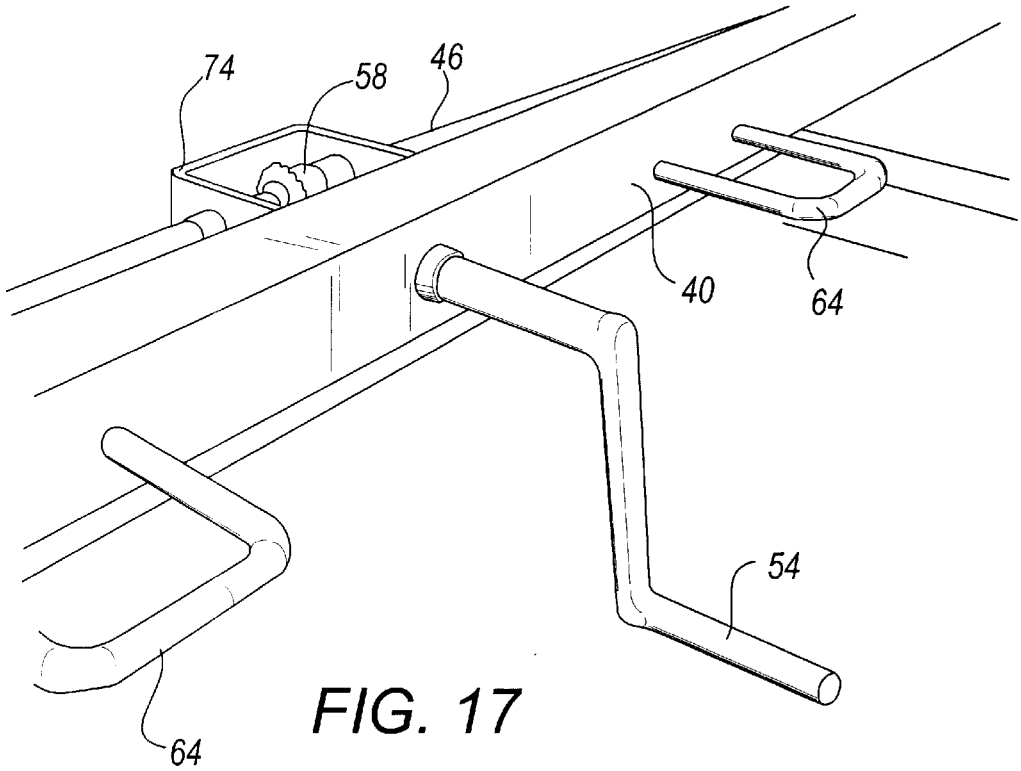
FIG. 17 is a perspective view of the embodiment of the drawer drive assembly of FIG. 16 with a crank.

Referring to FIG. 17, a perspective view of the drawer drive assembly is shown with the crank handle 54 attached to the crank handle key. The optional hand holds 64 are also visible in this figure.

Figure 18:
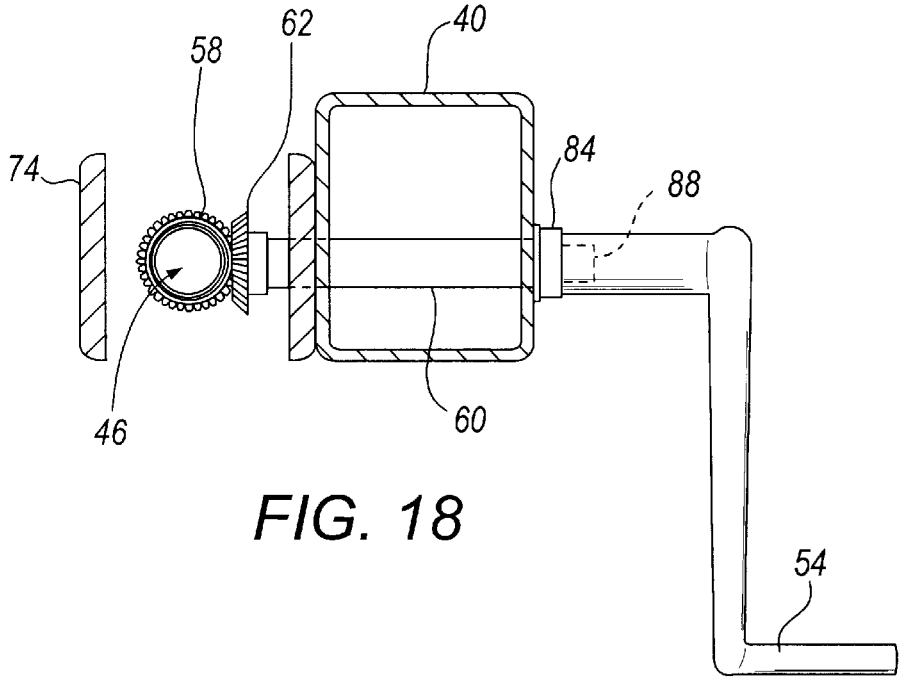
FIG. 18 is a cross-sectional view of the drawer drive assembly of FIG. 16.

Referring now to FIG. 18, a cross sectional view of the drawer drive assembly is provided. The coupling shaft 60 extends through the outer member 40, including attached bearing 84 on the external surface of the outer member 40, and into housing member 74. A second gear 62 is attached to the interior end of the coupling shaft 60 and engages the first gear 58 attached to the main shaft 46. The exterior end of the coupling shaft 60 includes the crank handle key 88. A crank handle 54 is shown engaging the crank handle key 88 and connected to the coupling shaft 60.

Figure 19:
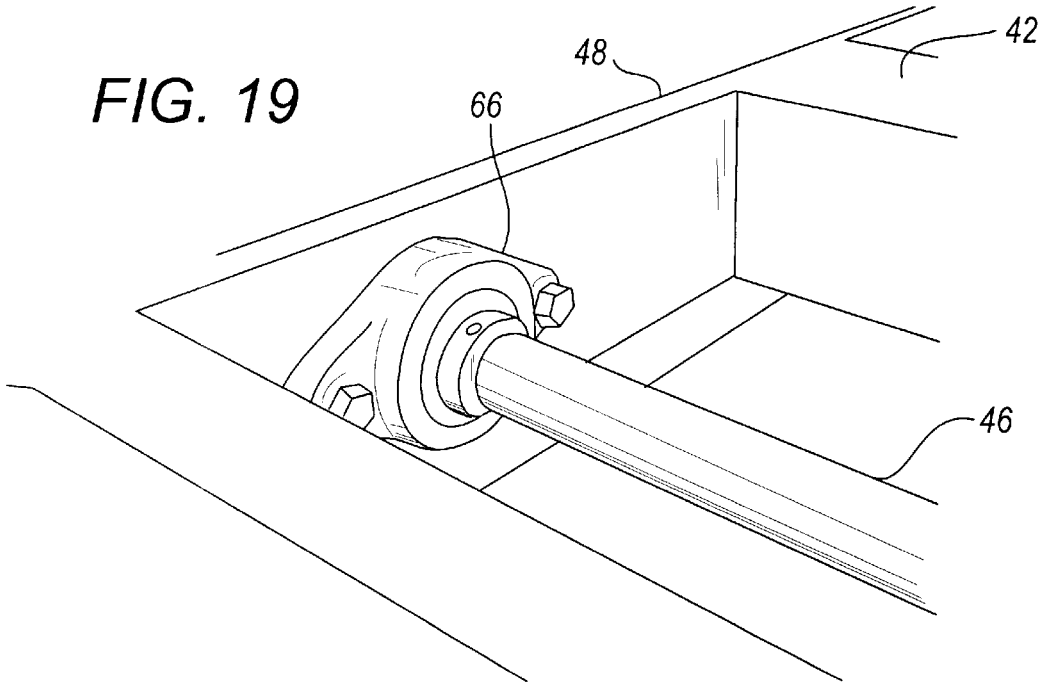
FIG. 19 is a perspective view of the drawer drive assembly showing one embodiment of the attachment of the flange bearing.

Referring now to FIG. 19, a perspective view of the main shaft 46 and drawer lateral side 48 connection is provided. In this embodiment, a flange bearing 66 is provided on the inner surface of the lateral side 48. The flange bearing 66 is attached to the lateral side 48 and supports the main shaft 46 as it extends through the flange bearing 66 and the lateral side 48.

Figure 20:
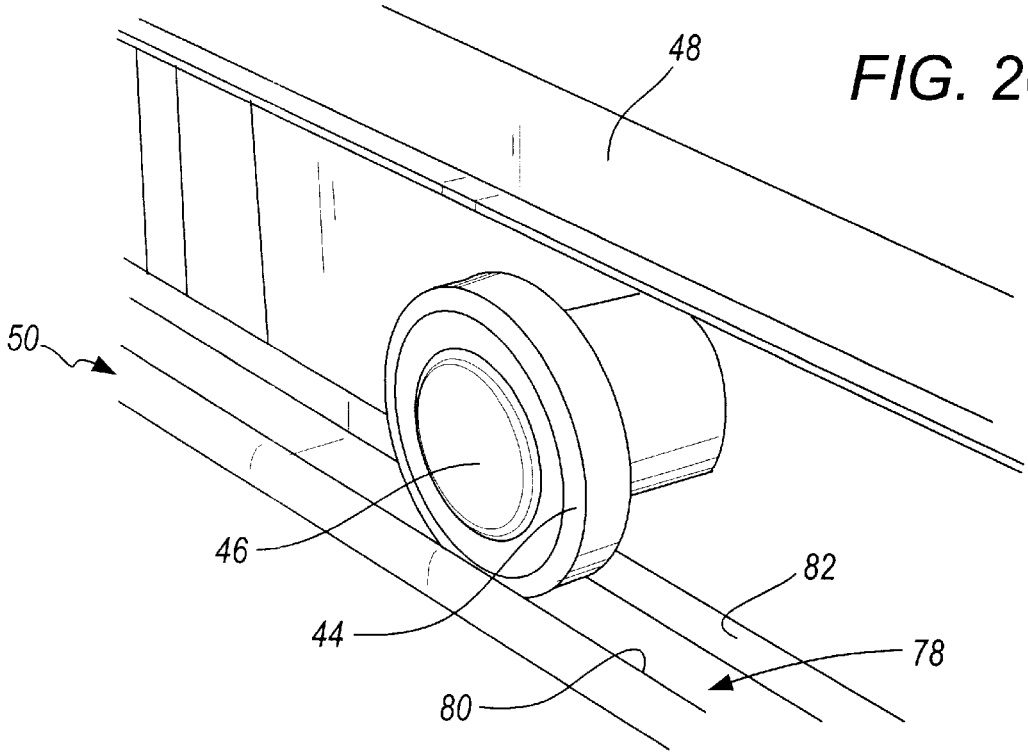
FIG. 20 is a perspective view of the drawer drive assembly embodiment of FIG. 19 showing the wheel in relation to the track member.

With reference to FIG. 20, a exterior perspective view of the embodiment of FIG. 19 is shown. In this embodiment, the drive wheel 44 is shown connected to the main shaft 46. The drive wheel 44 is seated within the track member 50 between the outer surface 78 and the inner surface 80 thereof.

It should be noted that a drawer drive assembly 70 can be provided with each individual drawer. Only one crank handle 54 is required however. The crank handle 54 may be removed from the coupling shaft 60 of the last moved drawer 38 when the closing, for example, is completed. At that time, the crank handle 54 may be removed from the coupling shaft 60 of that drawer placed on the coupling shaft 60 of the drawer 38 desired to be moved next.

Although not shown in a drawing, it is anticipated that an alternative embodiment of the crank handle 54 may be desirable for opening and closing drawers 38 near the floor or above an individuals head. In this embodiment, a crank handle 54 may be provided with an elongated shaft with a crank at one end and a universal joint at the other for connecting to the crank handle key 88. The universal joint would allow the individual to maintain the elongated shaft of the crank handle 54 at a relatively constant angle with the floor while rotating the crank handle 54.

It will be understood that the invention may be embodied in other specific forms without departing from the spirit and central characteristics thereof. The present examples and embodiments, therefore, are to be considered in all respects as illustrative and not restrictive, and the invention is not intended to be limited to the details given herein.

What is claimed is:

1. An apparatus that supports materials above a floor surface, comprising:

a rack assembly including first and second side frames having first and second track members and at least a first drawer having an outer member with a longitudinal extent that is movable and can support materials above the floor surface, said first drawer having a length in a direction substantially perpendicular to said longitudinal extent of said outer member, said first drawer having a closed position and an open position in which said first drawer extends outwardly of said first and second side frames and, when in said open position, less than a majority of said first drawer length extends outwardly of said first and second side frames; and at least a first drawer drive assembly including a first main shaft and first and second wheels joined to said the first main shaft, said first and second wheels being movable relative to said first and second side frames along said first and second track members, said first main shaft extending along said length of said first outer member, said first drawer drive assembly also including a shaft coupling device for causing movement of said first main shaft and in which said first main shaft is located closer to all portions of said shaft coupling device than to the floor surface, wherein said first and second wheels move in a lateral direction relative to said first and second side frames.

2. An apparatus, as claimed in claim 1, wherein:

said shaft coupling device includes a coupling shaft and said first drawer drive assembly includes a gear mechanism in which said coupling shaft is operably connected to said first main shaft using said gear mechanism.

3. An apparatus, as claimed in claim 2, wherein:

said gear mechanism includes a first gear connected to said first main shaft and a second gear connected to said coupling shaft.

4. An apparatus, as claimed in claim 2, wherein:

said shaft coupling device includes a crank handle connected to said coupling shaft.

5. An apparatus, as claimed in claim 2, wherein:

said coupling shaft is disposed in substantially the same plane as said first main shaft.

6. An apparatus, as claimed in claim 2, wherein:

said coupling shaft is substantially perpendicular to said first main shaft.

7. An apparatus, as claimed in claim 1, wherein:

said drawer drive assembly includes a first flange bearing connected to said first main shaft, with at least portions of said first flange bearing being inward of an inner wall of said first track member and said first wheel being located outwardly of an outer wall of said first track member.

8. An apparatus, as claimed in claim 1, wherein:

said drawer drive assembly includes a housing member within which portions of said main shaft are disposed and said drawer drive assembly also includes a gear mechanism connected to said main shaft and at least portions of said gear mechanism are contained within said housing member, said housing member being connected to an inner wall of said outer member.

9. An apparatus, as claimed in claim 8, wherein:

said gear mechanism includes a first gear connected to said main shaft and a second gear operably connected to said first gear and with each of said first and second gears being disposed within said housing member.

10. An apparatus that supports materials above a floor surface, comprising:

a rack assembly including a plurality of drawers including at least a first drawer and a second drawer, each of said first and second drawers having an outer member with a length, said rack assembly including first and second side frames wherein each of said first and second drawers can be moved in and out relative to said first and second side frames, each of said plurality of drawers including said first drawer and said second drawer being vertically spaced from each other such that materials can be supported on said first and second drawers, said first drawer having a length in a direction substantially perpendicular to said outer member length of said first drawer, said first drawer having a closed position and an open position in which said first drawer including said outer member extends outwardly of said first and second side frames and, when in said open position, less than a majority of said first drawer length extends outwardly of said first and second side frames;

a first drawer drive assembly connected to said first drawer, said first drawer drive assembly including a first main shaft that has a longitudinal extent in a direction along said length of said first outer member and first and second wheels connected to said first main shaft and in which said first and second wheels can be moved along portions of said first and second side frames when moving said first drawer in and out, wherein said first and second wheels remain supported by said first and second side frames when said first drawer is in said open position and in which said first and second wheels move in a lateral direction relative to said first and second side frames; and a second drawer drive assembly including a second main shaft and third and fourth wheels connected to said second main shaft.

11. An apparatus, as claimed in claim 10, wherein:

said first main shaft is closer to said second main shaft than to the floor surface.

12. An apparatus, as claimed in claim 10, wherein:

said first drawer drive assembly includes a coupling device operably connected to said first main shaft, said coupling device used in causing movement of said first main shaft and in which said first main shaft is located closer to all portions of said coupling device than to the floor surface.

13. An apparatus, as claimed in claim 12, wherein:

said coupling device includes at least one of a coupling shaft and a shaft moving unit.

14. An apparatus, as claimed in claim 13, wherein:

said coupling device includes said coupling shaft and said shaft moving unit includes a crank handle connected to said coupling shaft, with said coupling shaft being in substantially the same plane as said first main shaft and being substantially perpendicular to said first main shaft.

15. An apparatus, as claimed in claim 10, wherein:

said first drawer drive assembly includes a gear mechanism connected to said main shaft and being adjacent to said outer member.

16. An apparatus, as claimed in claim 15, wherein:

said gear mechanism includes a first gear connected to said main shaft.

17. An apparatus, as claimed in claim 10, wherein:

said first drawer drive assembly includes a coupling shaft and a gear mechanism connected to said coupling shaft, said gear mechanism including a first gear connected to said first main shaft and a second gear connected to said coupling shaft and with said coupling shaft and said gear mechanism being located closer to said first main shaft than to the floor surface.

18. An apparatus, as claimed in claim 10, wherein:

said first drawer drive assembly includes a first flange bearing spaced from but adjacent to said first wheel.

19. An apparatus, as claimed in claim 18, wherein:

said first side frame includes a track member having an outer surface and an inner surface, said first wheel being located outward of said outer surface and said flange bearing having at least portions located inward of said inner surface.

20. An apparatus, as claimed in claim 10, wherein:

said first drawer drive assembly includes a housing member and with portions of said first main shaft being within said housing member, said drawer drive rack assembly also including a first gear connected to said first main shaft and being disposed within said housing member.

21. An apparatus, as claimed in claim 10, wherein:

each of said first and second wheels has a circumferential periphery that engages said portions of said first and second side frames, respectively, and with said circumferential periphery being substantially smooth.

22. An apparatus, as claimed in claim 10, wherein:

said first drawer length ends at said outer member of said first drawer and said first main shaft is located closer to said first drawer outer member than to an opposite end of said first drawer length.

* * * * *